United States Patent [19]

Simon

[11] Patent Number: 4,614,331

[45] Date of Patent: Sep. 30, 1986

[54] LIFTING PULLEY BLOCK

[76] Inventor: Francois Simon, Route d'Annecy, 73410 Albens, France

[21] Appl. No.: 677,915

[22] Filed: Dec. 4, 1984

[51] Int. Cl.[4] ..... B66D 3/02

[52] U.S. Cl. ..... 254/390; 254/389; 254/415

[58] Field of Search ..... 254/390, 387, 325, 327, 254/264, 384, 389, 396, 398, 399, 409, 411, 415; 294/82.1, 82.11, 1.1

[56] References Cited

U.S. PATENT DOCUMENTS 413,389 10/1889 Cruikshank ..... 254/323 X
851,732 4/1907 Deschambault ..... 294/82.1 X
2,669,425 2/1954 Gaskin ..... 254/390
2,961,216 11/1960 Blair ..... 254/387
3,290,009 12/1966 Carper et al. ..... 294/1.1

FOREIGN PATENT DOCUMENTS 638076 3/1962 Canada ..... 254/387

*Primary Examiner*—Donald Watkins
*Attorney, Agent, or Firm*—Toren, McGeady, Stanger, Goldberg & Kiel

[57] ABSTRACT

In order to bring a pulley block close to the load to be hauled, same is provided with a carriage, removable or not, and possibly completed by a drawbar, the carriage including means for rolling on the ground and means for its fixation to the pulley block.

6 Claims, 10 Drawing Figures

LIFTING PULLEY BLOCK

This invention relates to lifting pulley blocks, that is pulley blocks which are suspended to a lifting unit, notably at the head thereof, for receiving the load, for example by means of a hook.

It is known that a lifting pulley block can be used either for a lifting operation as such, that is for the lifting or lowering of a load along a vertical path during which motion the load and the pulley block are always in vertical alignment with the end of the lifting unit, or for a hauling operation, that is for towing a load remaining on its support and situated out of vertical alignment with the unit end.

The invention relates to the particular use of lifting pulley blocks for hauling purposes.

For hauling operations, if it is not possible to bring the unit end in vertical alignment with the load in order to hook the latter to the pulley block, it is necessary to displace said pulley block toward the load by moving it away from the vertical of the unit end. This can be done by using a sling attached to the pulley block and by exerting a traction on said sling, as the lifting cable is unwound, in order to bring the still suspended pulley block toward the load. But this operation is possible only if the load is not too distant, since if the pulley block is heavy the traction forces which are necessary exceed widely those of the slinger, unless several slingers are working together, thereby making the operation very labour-intensive and costly. Another method consists in lowering the pulley block down to the ground and to have it pulled by workers toward the load, said method having the same drawback.

The object of the invention is to solve said difficulties by providing a lifting pulley block which can be easily move to the load by a single slinger and without excessive efforts.

To that effect, the lifting pulley block according to the invention is characterized by the fact that it comprises a carriage provided with means for rolling same on the ground and with means for its securing to the pulley block.

The carriage is advantageously completed by a drawbar, also attached to the pulley block, forming simultaneously a hand-operated gripping means and a tipping means for the pulley block, when its free end engages the ground as the pulley block is lowered, in order to make the pulley block bear on the ground via the rolling means of the carriage.

Preferably, the carriage and/or the drawbar are removable.

The invention will become more apparent from the reading of the following description of a preferred embodiment of the invention with reference to the accompanying drawings wherein.

Figure 1:
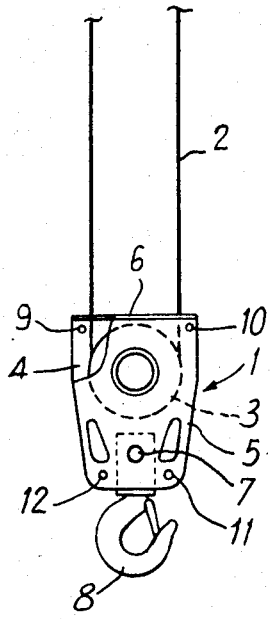
FIG. 1 is an elevation view with parts cut out of a lifting pulley block according to the invention.

In FIG. 1 is shown a lifting pulley block 1, known per se, which is suspended to a lifting unit (not shown), for example at the end of a crane boom, via a lifting cable 2.

Cable 2 runs on at least one return idle pulley 3 mounted on pulley block 1. Depending on the type of block, there can be either only a single pair of suspension ends of the pulley block and a single pulley 3, or several pairs of cable ends and as many coaxial idle pulleys 3 as there are pairs of ends.

Moreover, pulley block 1 comprises two side flanges 4, 5 connected at their upper portion by a notched plate 6 and at their lower portion by an articulated suspension pin 7 for a lifting hook 8.

At their upper facing corners the flanges are connected by two rods 9, 10 between which runs cable 2 and which form safety cable guides.

Figure 4:
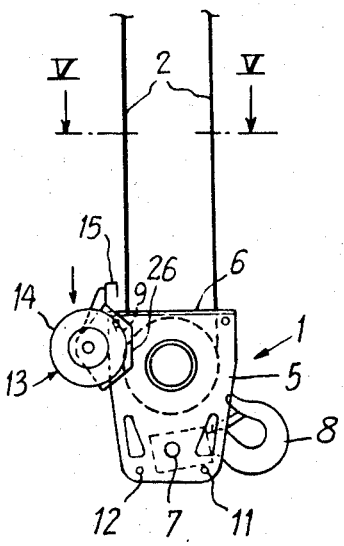
FIGS. 4 to 10 are views similar to FIG. 1 and show the putting in position of the carriage and drawbar on the pulley block and the operation of the pulley block thus equipped, FIG. 5 being a view along line V—V of FIG. 4.

Hook 8 can be retracted by being lifted about articulation 7 (FIG. 4). For so doing, flanges 4, 5 are formed, in one of their lower facing corners, with aligned openings 11 receiving a stand-by latching spindle (not shown). In order to retract hook 8, the spindle is removed, the hook is lifted by making it tip about pin 7, moved past openings 11 and the spindle is put back in position, thereby latching the hook in a retracted position as shown in FIG. 4.

Flanges 4, 5 are formed, in their other lower facing corners, with two alined openings 12 receiving a stand-by latching spindle (not shown).

Figure 2:
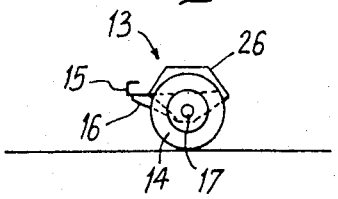
FIG. 2 is a side view of the carriage.

In order to move pulley block 1 on the ground by rolling it, there is provided a carriage 13 (FIG. 2) having rolling means 14, for example two wheels, and means 15 for hooking it to the pulley block on the side opposite to that on which hook 8 has been retracted.

Figure 5:
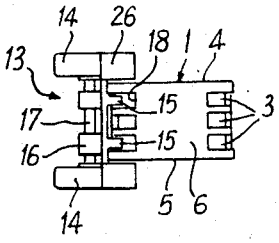

Moreover, carriage 13 comprises a frame 16 carrying a support axle 17 for wheels 14. In order that the carriage be mounted on the side of the pulley block, frame 16 carries said hooking means 15 formed of two spaced apart hooks, arranged so as to cooperate with the cable-guide rod 9 by extending through notch 18 formed in the fixed upper plate 6 of the pulley block for the passage of the cable. Hooks 15 are arranged so as to come laterally in abutment against the periphery of said notch so as to correctly center the carriage with respect to the pulley block. Wheels 14 are placed at the ends of axle 17 so as to be outside flanges 4, 5 (FIG. 5) when mounting the carriage. Frame 16 of the carriage is arranged for coming in abutment against the side edges of flanges 4, 5. It can also carry mudguards 26.

Figure 6:
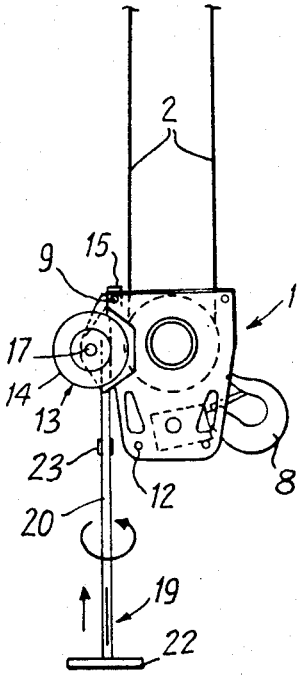

For mounting carriage 13 on pulley block 1, the latter is lifted to the height of a man, the carriage is manually seized and brought to the position of FIG. 4, the wheels 14 being on the side outside the flanges, the hooks 15 turned downwardly and positioned above rod 9, and frame 16 bearing against the sides of flanges 4, 5. The carriage is then lowered from the position of FIG. 4 to that of FIG. 6 so that hooks 15 cooperate with rod 9, position in which the carriage is hooked and suspended to the pulley block while bearing on the edges of flanges 4, 5 via its frame 16.

Figure 3:
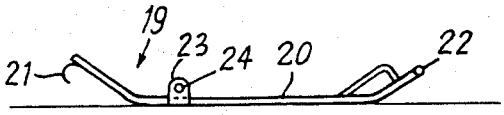
FIG. 3 is a side view of the drawbar.

Carriage 13 can be latched in this position by appropriate means (spindle, hook, etc...) but preferably said latching is provided by a drawbar 19 (FIG. 3) which is moreover used for moving the pulley block on the ground and for tipping it automatically when the pulley block is descending to the ground so that it can rest on the latter via wheels 14.

Drawbar 19 (FIG. 3) includes an elongated rod 20 bent at its two ends over about 30° in the same plane. One end carries a hook 21 for cooperating with axle 17 of carriage 13 and the other end is T-shaped, the transverse branch 22 of the T forming a handle and a bearing means on the ground for tipping the pulley block. In an intermediate region, rod 20 carries two ears 23 the openings 24 of which are provided for coming in register with openings 12 of the pulley block.

Figure 7:
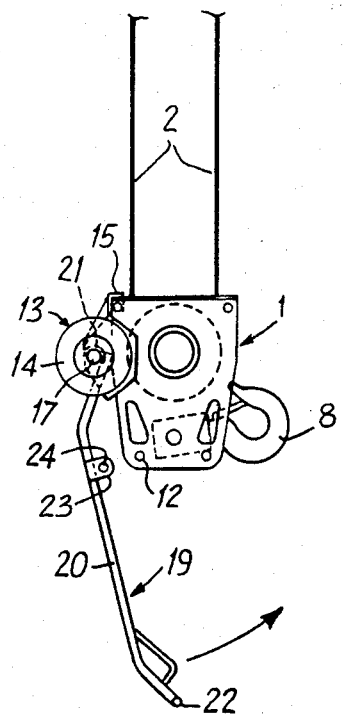

In order to put drawbar 19 in position on the pulley block already fitted with carriage 13, it is presented in a vertical position (FIG. 6) so that when lifting it its extreme hook 21 passes between the carriage axle 17 and the pulley block; it is then turned over 90° so that hook 21 be in vertical alignment with axle 17, and it is let down again (FIG. 7) in order to cooperate with the latter. Then, the drawbar is tipped under the pulley block (FIG. 7) about axle 17, so that openings 24 of ears 23 come in alignment with openings 12 of the flanges, the latching spindle having been previously removed. In this position, the spindle is inserted into the four aligned holes 12, 24. The carriage 13 - drawbar assembly 19 is thus firmly secured to the pulley block 1 in a removable manner (FIG. 8).

Figure 8:
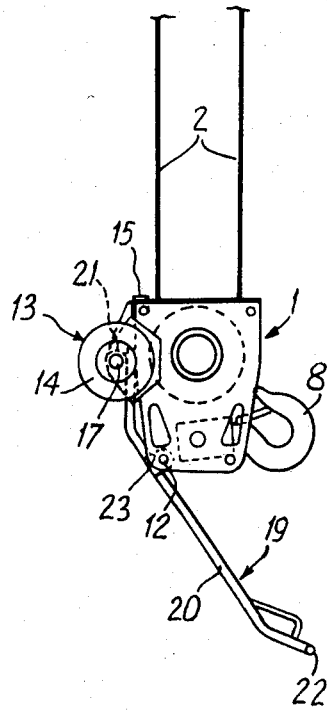
Figure 9:
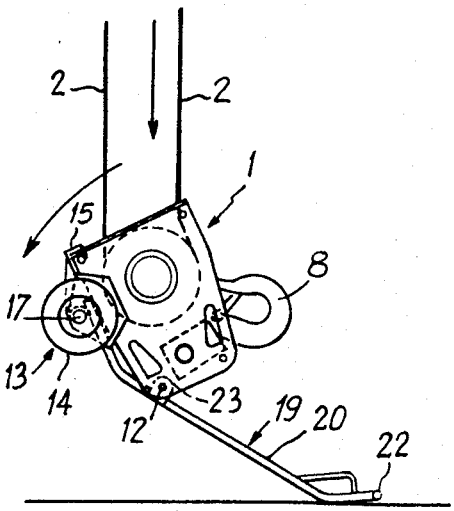
Figure 10:
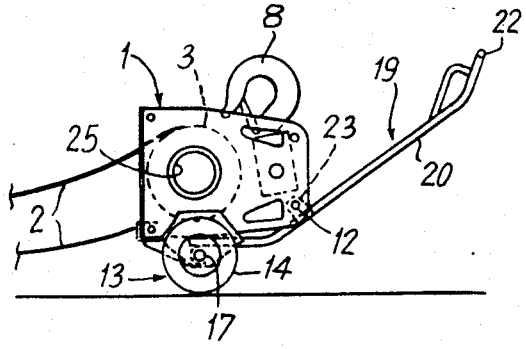

As shown in FIG. 8, the length of drawbar 19 and its two extreme elbows are such that, after mounting, the transverse branch 22 which is at the operating end of the drawbar extends widely out of vertical alignment with the pulley block, on the other side of the carriage with respect to the pulley block. The result is that, when the pulley block is moved downwardly, said branch 22 is the first to engage with the ground and then forms a tipping point for the pulley block. During this tipping motion of the pulley block (FIG. 9), which can be guided without effort by the slinger, wheels 14 come closer to the ground for finally establishing a contact therewith, the only thing which the slinger has to do being to seize branch 22, forming then a handle, for moving the pulley block by rolling it, cable 2 being unwound correspondingly (FIG. 10).

It will be noted that carriage 13 is arranged such that when it is in a position for rolling on the ground, that is when the pulley block is tipped over about 90° with respect to its normal lifting position, its centre of gravity is close to the vertical alignment with axle 17 of wheels 14, thereby allowing the slinger to move the pulley block by rolling it without effort on the ground.

Once the pulley block is close to the load, said load is hooked in the usual manner either to hook 8 previously freed or to a suspension member axially passed through the bore 25 of pulley 3. Drawbar 19 and carriage 13 are left in position at the beginning of the hauling operation, at least until pulley block 1, maintained by the load and towed by cable 2, is lifted from the ground, thereby allowing access to the drawbar and to the carriage and allowing therefore their disassembly.

In the embodiment described, the drawbar and the carriage are removable, it being understood that within the scope of the invention it is also possible that they can be left assembled. Carriage 13, for the normal lifting operations, interferes neither with cable 2 nor with pulley 3, nor with hook 8; therefore, it can remain permanently in position. As regards drawbar 19, it is either removable, in which case an extra latching means of the carriage on the pulley block, if the carriage is permanently fixed, has to be provided, as previously mentioned, or it is also permanently fixed, in which case the portion of rod 20 extending beyond the latching spindle can be retracted toward the carriage in order not to interfere with the hook.

As a modification, the portion of the rod extending between hook 21 and ears 23 could be included in the frame 16 of the carriage and drawbar 19 could be formed by the rest of rod 20 which would then be removable and received by frame 16 by any appropriate means (sleeve, etc. . .).

I claim:

1. In a lifting and hauling unit, the combination of a pulley block suspended by a lifting and hauling cable from a boom, a wheeled carriage secured to said pulley block for rolling said pulley block on the ground when in a lowered position, and a removable drawbar being removably secured to said pulley block and extending substantially downwardly from said pulley block when said pulley block is raised from the ground and suspended from said boom, said drawbar comprising a free end portion which, upon contact with the ground, causes said pulley block and said carriage secured thereto to tip until the carriage wheels contact the ground, said free end portion also forming a carriage handle for towing said pulley block on the ground.

2. The combination of claim 1, wherein said carriage includes two wheels located outside said pulley block.

3. The combination of claim 1, wherein said carriage comprises at least one hook for cooperating with a rod secured to said pulley block, said rod forming a cable-guide for said lifting and hauling cable.

4. The combination of claim 1, wherein said pulley block has a center of gravity which, when said pulley block has been tipped over substantially 90° from a normal lifting position to the position in which the carriage wheels roll on the ground, is substantially in vertical alignment with an axle of said carriage wheels.

5. The combination of claim 1, wherein said pulley block comprises two flanges, the edges of which bear against a carriage frame.

6. The combination of claim 1, wherein said end portion of said drawbar is located, when said pulley block is suspended, underneath said pulley block and on the other side of said carriage with respect to said pulley block.

* * * * *